US006993944B2

(12) United States Patent
Hicks

(10) Patent No.: US 6,993,944 B2
(45) Date of Patent: Feb. 7, 2006

(54) DEAD BOLT LOCK

(76) Inventor: Thurman B. Hicks, 12166 Black Water Rd., Baker, LA (US) 70714

( * ) Notice: Subject to any disclaimer, the term of this patent is extended or adjusted under 35 U.S.C. 154(b) by 80 days.

(21) Appl. No.: 10/699,342

(22) Filed: Nov. 3, 2003

(65) Prior Publication Data

US 2004/0107752 A1 Jun. 10, 2004

Related U.S. Application Data

(60) Provisional application No. 60/428,679, filed on Nov. 25, 2002.

(51) Int. Cl.
*E05B 13/00* (2006.01)
*E05B 15/00* (2006.01)
*E05B 17/00* (2006.01)

(52) U.S. Cl. ..... 70/416; 70/211

(58) Field of Classification Search ..... 70/211, 70/429, 430, 416; 292/288
See application file for complete search history.

(56) References Cited

U.S. PATENT DOCUMENTS

| | | | | | |
|---|---|---|---|---|---|
| 2,107,699 | A | | 2/1938 | Groeschel et al. | 16/86 |
| 2,515,364 | A | * | 7/1950 | Weaver | 292/359 |
| 3,869,886 | A | | 3/1975 | Diaz | 70/93 |
| 3,933,014 | A | * | 1/1976 | Moses | 70/416 |
| 4,048,822 | A | | 9/1977 | Luling | 70/93 |
| 4,155,577 | A | | 5/1979 | Raymond | 292/264 |
| 4,279,137 | A | * | 7/1981 | Cook | 70/416 |
| 4,478,442 | A | | 10/1984 | Martin | 292/248 |
| 4,673,202 | A | * | 6/1987 | Willis | 292/162 |
| 4,827,745 | A | * | 5/1989 | Baugh | 70/416 |
| 4,982,474 | A | | 1/1991 | Kjellstrom | 16/82 |
| 5,003,803 | A | * | 4/1991 | Richards | 70/416 |
| 5,007,263 | A | * | 4/1991 | Taylor | 70/416 |
| 5,035,128 | A | * | 7/1991 | Ridgway | 70/211 |
| 5,052,202 | A | * | 10/1991 | Murphy | 70/211 |
| 5,095,654 | A | | 3/1992 | Eccleston | 49/280 |
| 5,291,631 | A | | 3/1994 | Schjoneman | 16/86 R |
| 5,464,595 | A | * | 11/1995 | Finnah | 422/297 |
| 5,517,838 | A | * | 5/1996 | Moore | 70/416 |
| 5,725,263 | A | | 3/1998 | Rodriguez | 292/338 |
| 5,741,033 | A | | 4/1998 | Everett | 292/289 |
| 5,927,011 | A | | 7/1999 | Sickenius | 49/56 |
| 6,105,406 | A | * | 8/2000 | Thompson et al. | 70/416 |
| 6,301,941 | B1 | * | 10/2001 | Nicholsfigueiredo | 70/211 |
| 6,324,879 | B1 | * | 12/2001 | Kennedy | 70/416 |
| 6,327,743 | B1 | | 12/2001 | Rashid et al. | 16/82 |
| 6,742,369 | B1 | * | 6/2004 | Veillette | 70/416 |

* cited by examiner

*Primary Examiner*—John B. Walsh
(74) *Attorney, Agent, or Firm*—John M. Harrison

(57) ABSTRACT

A dead bolt lock having a slot or slots for insertion on a dead bolt and legs for spanning the underlying door knob of a door to secure the dead bolt. In an adjustable embodiment the dead bolt lock includes a lock housing having a circular rim and downwardly-extending legs, with notches disposed around the curved top portion of the housing rim. A round opening in the center of the housing rotatably accommodates at least a middle plate, closed by front plate, and a rear plate, the middle plate provided with a middle plate profile slot for receiving a sliding retainer block. The retainer block alternately recesses in a corresponding retainer block slot adjoining the middle plate profile slot and extends into the middle plate profile slot for selective engagement with the dead bolt when the dead bolt lock is in locked configuration. The front plate and rear plate are connected to the middle plate and each have slots that correspond to the middle plate profile slot for accommodating the dead bolt. Spring-loaded adjusting and keeper mechanisms are slidably recessed in the middle plate to facilitate rotating and locking the rear plate, middle plate and front plate in concert on a dead bolt oriented in any angular locked position on a door. Fixed, vertical, horizontal, X-slot and cross-slot configurations are also alternatively provided in the lock housing for accommodating dead bolts in various angular locked configurations.

20 Claims, 6 Drawing Sheets

DEAD BOLT LOCK

CROSS-REFERENCE TO RELATED APPLICATIONS

This application claims the benefit of and incorporates by reference prior filed copending U.S. Provisional Application Ser. No. 60/428,679, filed Nov. 25, 2002.

BACKGROUND OF THE INVENTION

SUMMARY OF THE INVENTION

This invention secures dead bolt locks in a fixed or adjustable slot embodiment and is capable of fitting on a dead bolt knob disposed in any angular position on a door having a door knob, to secure the dead bolt against rotation to the unlocked position. In a preferred adjustable embodiment the dead bolt lock is characterized by a circular housing having downwardly-extending, spaced-apart, parallel legs and an open, round center, with front, middle, (or middle and backing) and rear plates attached to each other and rotatable on and in the housing and having matching facing slots or openings to accommodate the dead bolt when the adjustable dead bolt lock is positioned on the dead bolt and the legs extend downwardly between the door knob and the door. In the adjustable design, a spring-loaded retainer block is situated in a receiving profile slot in at least the middle plate in communication with the matching front plate dead bolt slot and the corresponding rear plate slot, for selective recession in the receiving middle plate profile slot and extension into the registering rear plate slot, to facilitate exerting a stabilizing force on the dead bolt knob when the dead bolt lock is located in functional configuration on the dead bolt knob. In an alternative embodiment a backing plate may include a backing plate slot and a sliding keeper and may be glued or otherwise fixed to the middle plate for rotation with the middle plate in the round center of the housing. Furthermore, notches are provided, typically 180-degrees around the curved top portion of the slot housing rim, to facilitate selectively inserting a spring-loaded notch leg in one of the notches responsive to manipulation of the spring-loaded keeper. Rotation of the connected front, middle and rear plates, as well as the backing plate, is facilitated in concert with respect to the housing and corresponding rotational adjustment of the front plate dead bolt slot, the middle plate profile slot, the backing plate slot and the rear plate slot together accommodates a dead bolt knob in any angular locked configuration on a door.

In fixed slot embodiments of the dead bolt lock of this invention the housing contains no adjustment feature, but instead, has an X-slot or a cross-slot, or a single vertical or horizontal slot for accommodating a dead bolt knob under circumstances where limited angular accommodation of the dead bolt is required. In the cross-slot embodiment a sliding plate may be provided on the dead bolt lock housing for engaging the dead bolt knob when the dead bolt lock is in functional configuration on the dead bolt knob.

The invention will be better understood by reference to the accompanying drawings, wherein.

Figure 3:
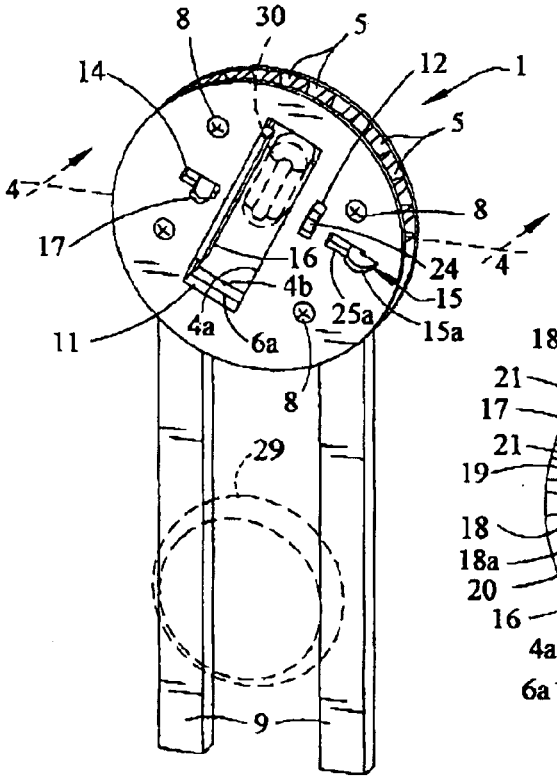
FIG. 3 is an enlarged perspective view of the adjustable dead bolt lock illustrated in FIG. 1, more particularly illustrating recession of the retainer block in the corresponding retainer block slot against spring tension in the middle plate to accommodate a locked dead bolt, illustrated in phantom.
Figure 4:
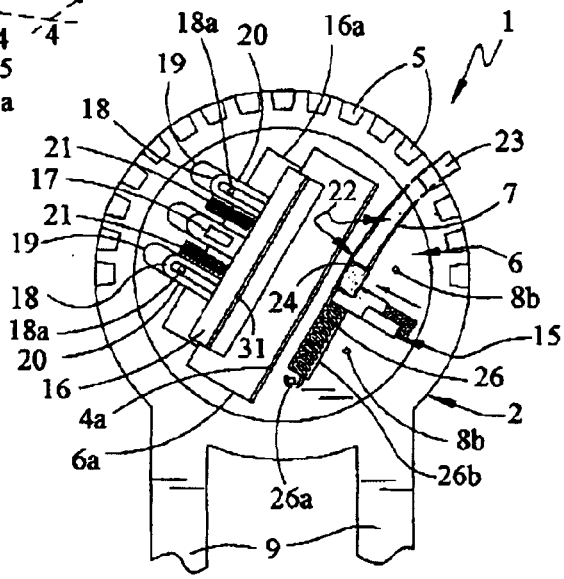
Figure 5:
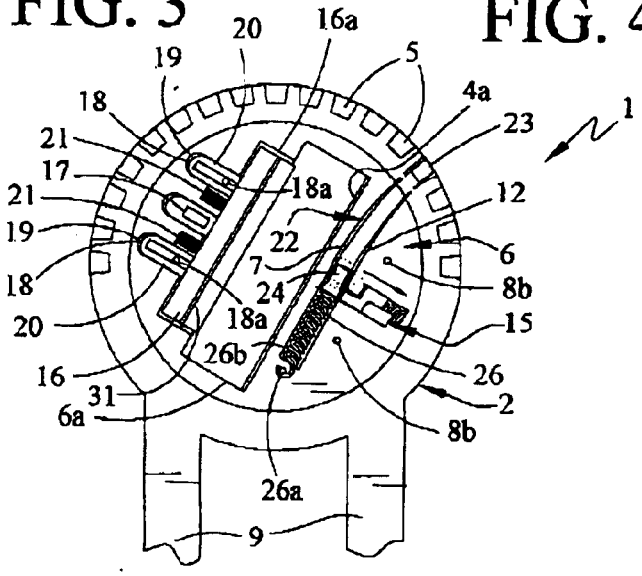
Figure 6:
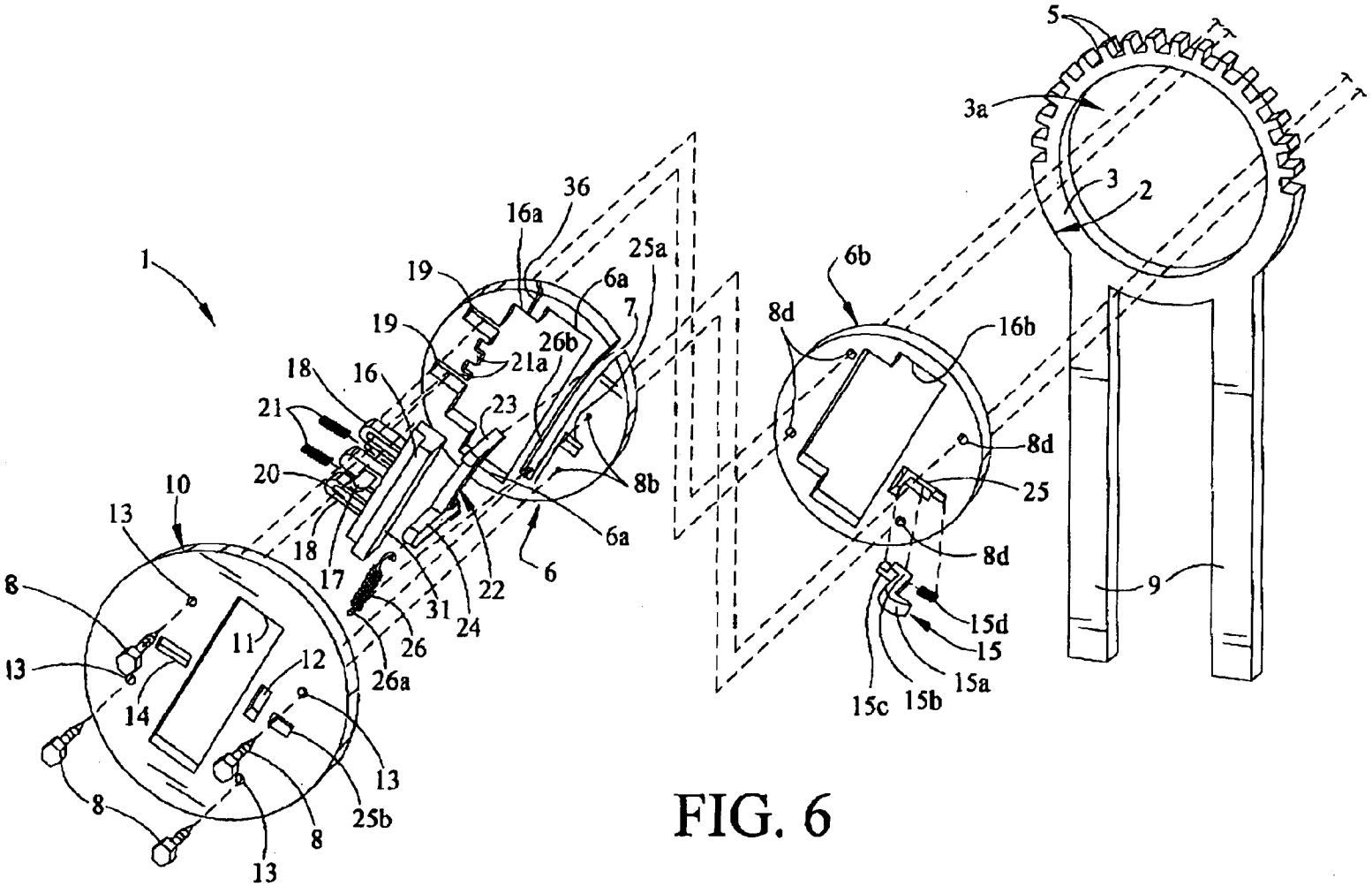
Figure 7:
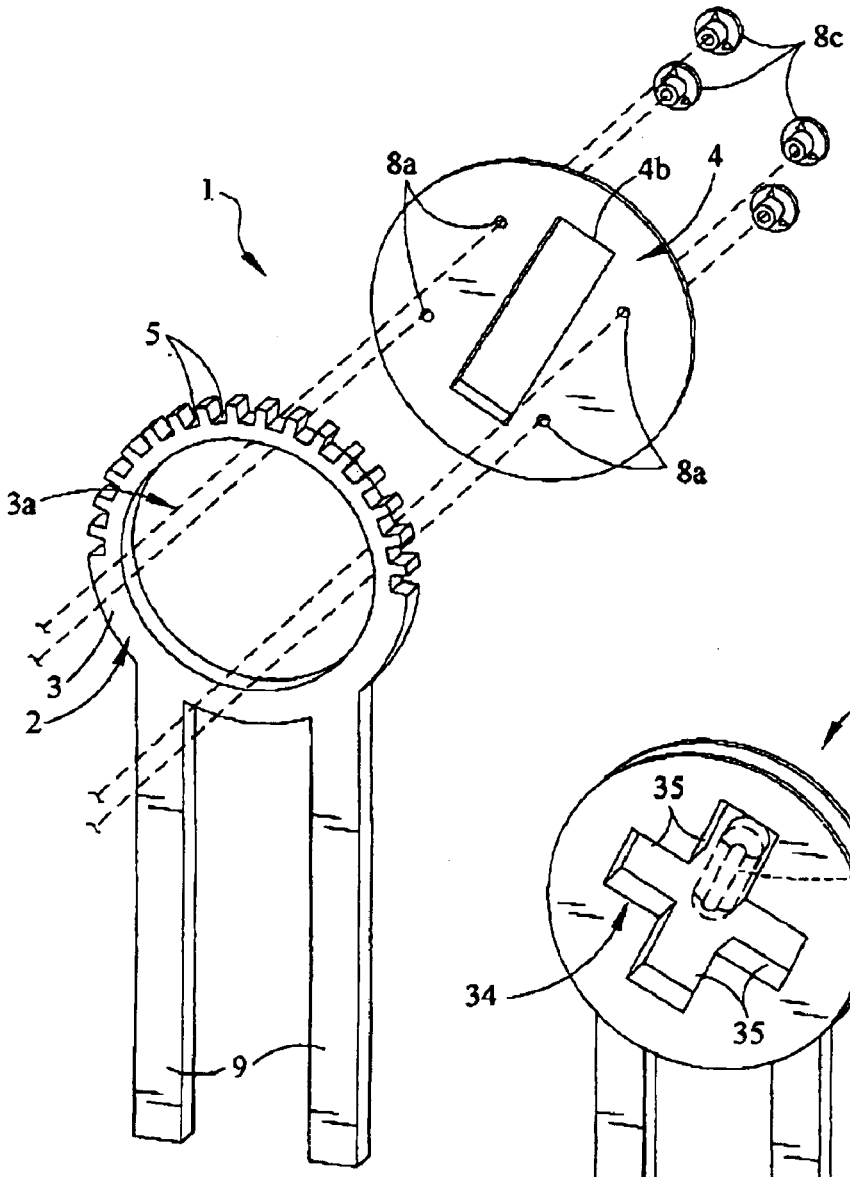
Figure 8:
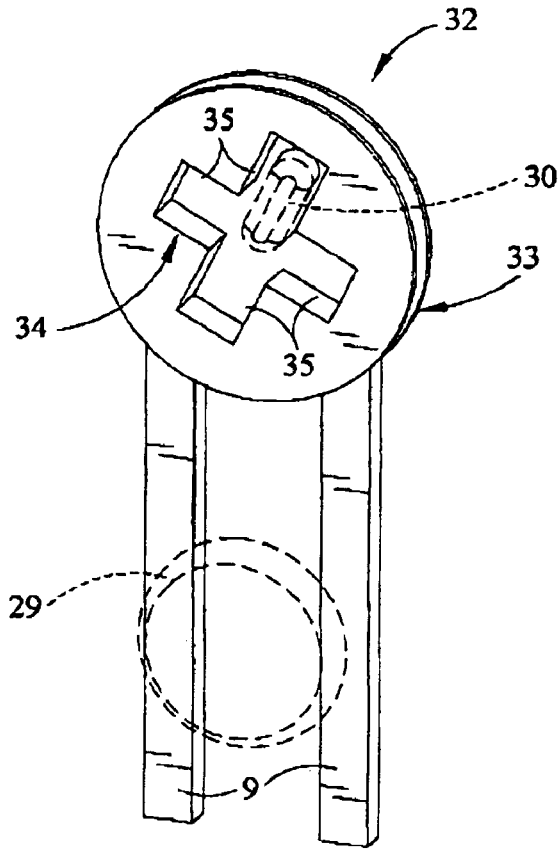
Figure 9:
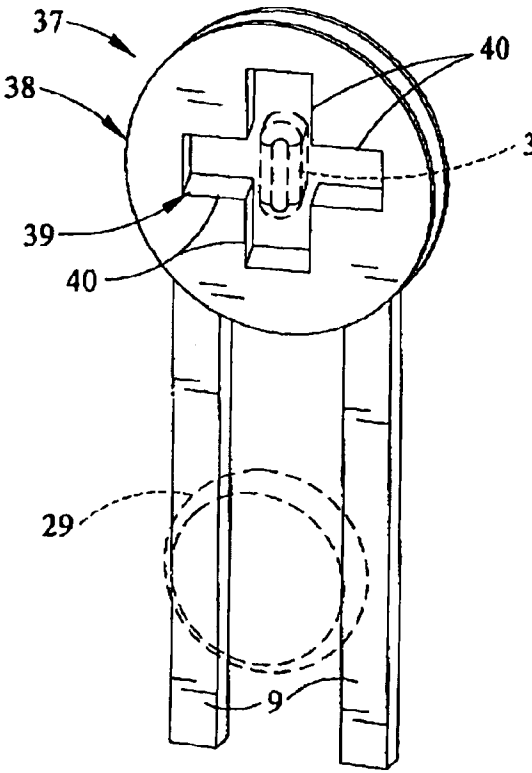

FIG. 4 is a sectional view taken along line 4—4 of the adjustable dead bolt lock illustrated in FIG. 3, more particularly illustrating preferred internal components of the adjustable dead bolt lock. These components include the retainer block, retainer block springs and the slotted plates attached to the retainer block, as well a notch retainer and retainer spring controlling the bias of the notch retainer and an associated keeper and keeper spring, all associated with the middle plate. The notch retainer is illustrated in unlocked configuration with respect to the slots provided in the rim of the lock housing by operation of the spring-loaded keeper;

FIG. 5 is a sectional view of the adjustable dead bolt lock illustrated in FIG. 4, more particularly illustrating removal of the keeper against spring-bias from contact with the notch retainer to facilitate bias of the notch leg element of the notch retainer by spring tension into the closed configuration in one of the slots provided in the rim of the lock housing. This configuration prevents rotation of the front, middle and back plates in concert with respect to the housing and allows the dead bolt lock to accommodate a dead bolt (not illustrated) in a particular angular locked configuration on a door;

FIG. 6 is an exploded view of an embodiment which includes front plate, middle plate and lock housing elements of the adjustable dead bolt lock illustrated in FIGS. 1–5, more particularly illustrating the front plate and middle plate removed from the lock housing;

FIG. 7 is an exploded view of the rear plate and lock housing elements of the adjustable dead bolt lock illustrated in FIG. 6, more particularly illustrating the housing and removed rear plate combination;

FIG. 8 is a perspective view of a non-adjustable X-slot embodiment of the dead bolt lock of this invention;

FIG. 9 is a perspective view of a non-adjustable cross-slot dead bolt lock of this invention.

Figure 11:
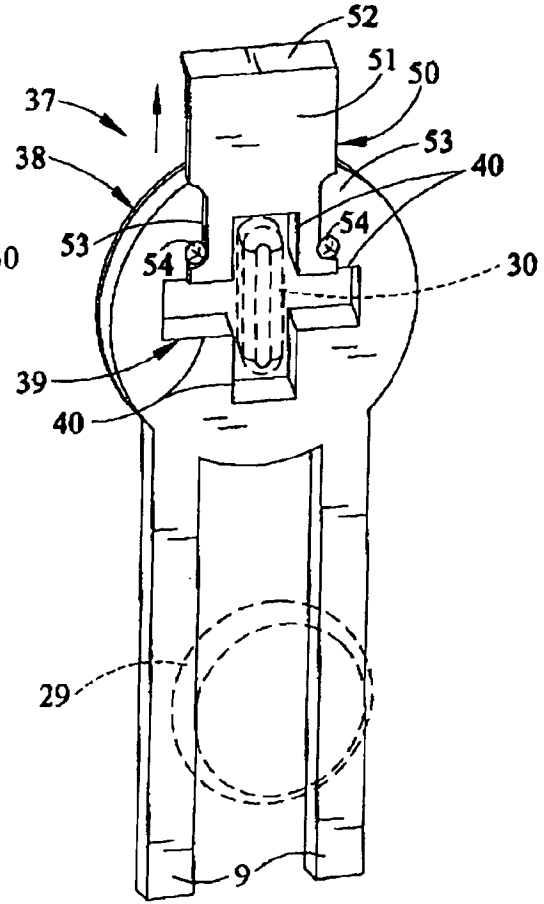
Figure 10:
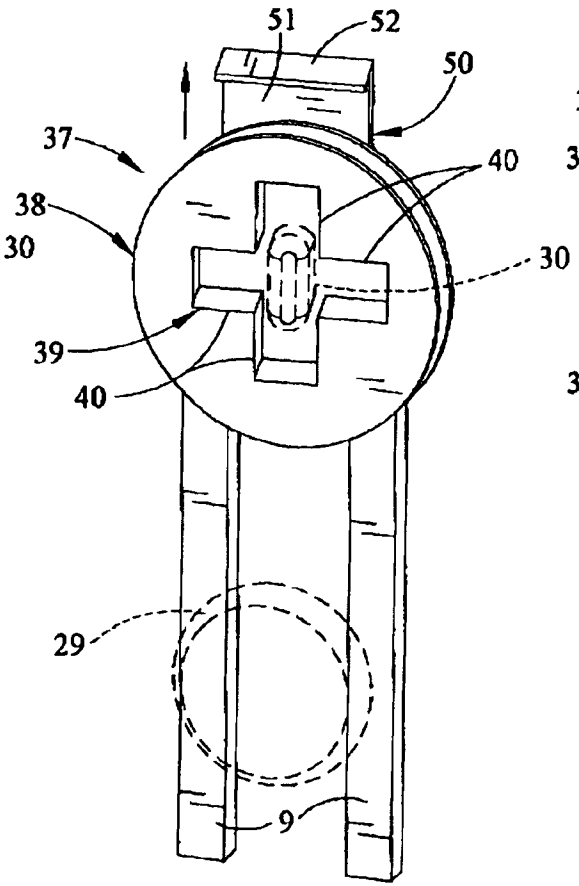
Figures 12, 13, 14:
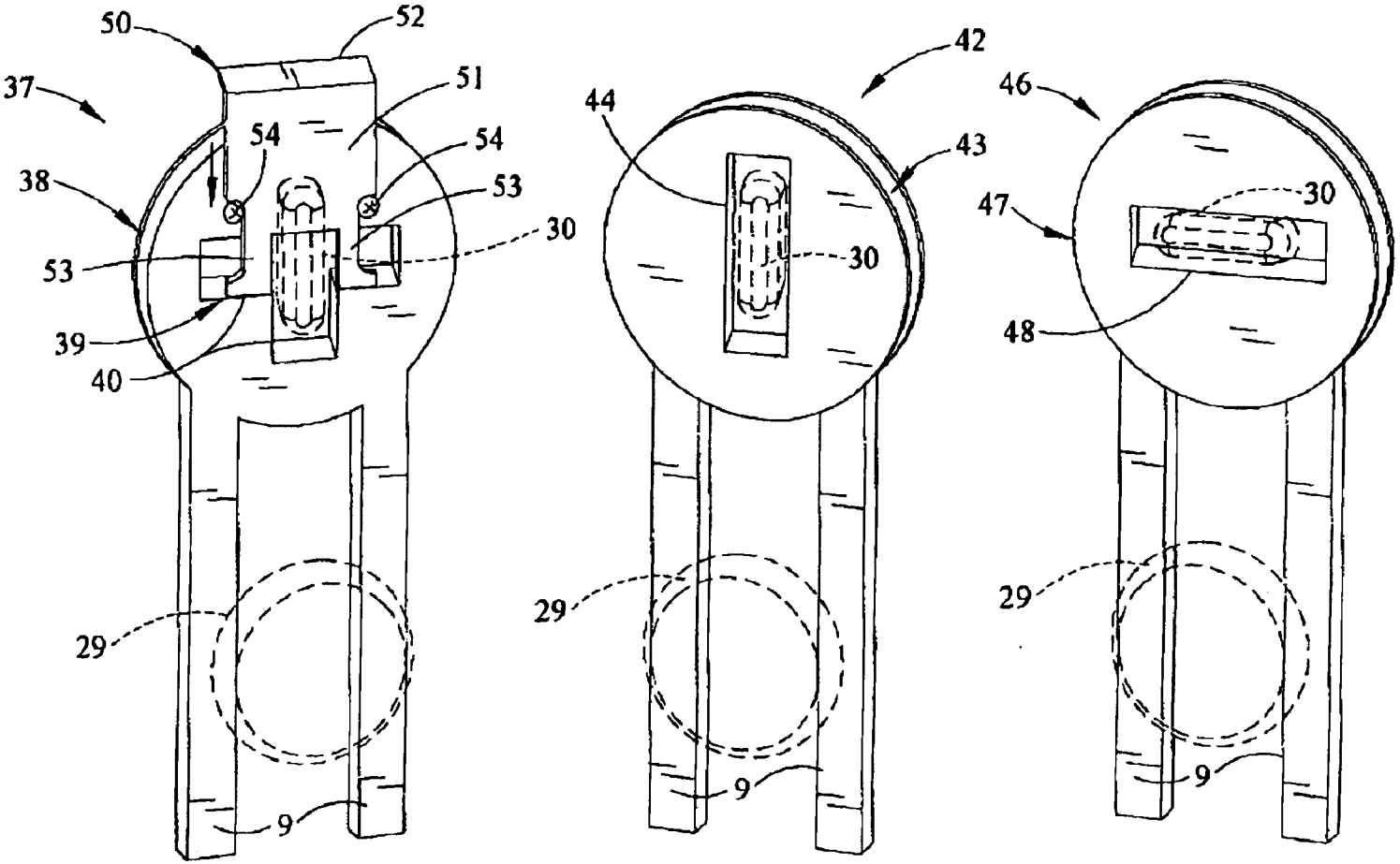

FIG. 10 is a front perspective view of the non-adjustable cross-slot dead bolt lock illustrated in FIG. 9, incorporating a sliding retainer plate oriented in dead bolt-disengaged configuration;

FIG. 11 is a rear perspective view of the non-adjustable cross-slot dead bolt lock with sliding retainer plate illustrated in FIG. 10;

FIG. 12 is a rear perspective view of the non-adjustable cross-slot dead bolt lock illustrated in FIG. 11, with the retainer plate engaging the dead bolt in functional configuration;

FIG. 13 is a perspective view of a non-adjustable vertical slot embodiment of the dead bolt lock of this invention; and FIG. 14 is a perspective view of a non-adjustable horizontal slot embodiment of the dead bolt lock of this invention.

DESCRIPTION OF THE PREFERRED EMBODIMENTS

Referring initially to FIGS. 1, 2, 6 and 7 of the drawings in a preferred embodiment the adjustable dead bolt lock of this invention is generally illustrated by reference numeral 1. The adjustable dead bolt lock 1 is characterized by a lock housing 2, typically having a circular housing rim 3 with a round housing opening 3*a* therein (FIGS. 6 and 7) and provided with spaced-apart rim notches 5, typically located on approximately the top 180-degree curved span of the housing rim 3, as further illustrated in FIGS. 6 and 7. A rear plate 4 closes the housing opening 3*a* on the back side of the housing rim 3 and the rear plate 4 is further characterized by a rear plate slot 4*b* (FIG. 7). In the embodiment illustrated in FIG. 6*a* front plate 10 is typically glued or otherwise fixed to a middle plate 6 and a backing plate 6*b* is attached to the front plate 10, the middle plate 6 and the rear plate 4 and is rotatably disposed in the housing opening 3*a* of the lock housing 2. The middle plate 6 has a middle plate profile slot 6*a* which aligns with a corresponding backing plate slot 16*b* in the backing plate 6*b* and both slots communicate with the round housing opening 3*a* in the lock housing 2 and the rear plate slot 4*b*. The middle plate 6 further includes a retainer block slot 16*a*, fitted with a pair of adjacent spring slots 21*a* and slotted plate openings 19, for receiving corresponding retainer block springs 21 and slotted plates 18, respectively, as further illustrated in FIGS. 4–6. Each of the slotted plates 18 is further provided with a linear slotted plate slot 20, for purposes which will be hereinafter described. Further included in the middle plate 6 is a notch leg articulation slot 7 that extends through the outer circumference of the middle plate 6 and may be slightly curved to accommodate a notch retainer 22, having a rearwardly-extending notch leg 23 on one end and a forwardly-projecting gripping leg 24 on the other end, for purposes which will be hereinafter further described. Furthermore, a retainer spring 26 is seated in a retainer spring slot 26*b* that joins the notch leg articulation slot 7 and has one end in engagement with the projecting gripping leg 24 of the notch retainer 22 and the opposite end of the retainer spring 26 is fixed to a post or pin on the middle plate 6, by means of a spring pin 26*a* (FIGS. 4 and 5). A keeper 15 is seated in a keeper slot 25 in the backing plate 6*b*, which keeper slot 25 extends transverse to the notch leg articulation slot 7 which receives the notch retainer 22, as further illustrated in the middle plate 6 in FIG. 6. The keeper 15 includes a keeper finger 15*a* that extends forwardly through a keeper leg slot 25*a* in the front plate 10 and a keeper leg 15*b*, which selectively projects into the keeper slot 25 in the backing plate 6*b* and has a leg notch 15*c* that selectively engages the gripping leg 24 of the notch retainer 22, for purposes which will be hereinafter further described. A keeper spring 15*d* is also seated in the keeper slot 25 in the backing plate 6*b* and serves to bias the keeper 15 normally into contact with the gripping leg 24 of the notch retainer 22.

As further illustrated in FIGS. 6 and 7 of the drawings a retainer block 16 is seated in the retainer block slot 16*a*, provided in the middle plate profile slot 6*a* of the middle plate 6 and in the aligned middle profile slot 6*a* and backing plate slot 16*b* in the middle plate 6 and backing plate 6*b* (FIG. 6). The spaced-apart slotted plates 18 extend from the retainer block 16 and register with the corresponding longer slotted plate openings 19. Furthermore, as illustrated in the FIG. 6, the retainer block 16 is shaped to extend through the backing plate slot 16*b*, into the rear plate slot 4*b* and is biased by the two retainer block springs 21, seated in the corresponding spring slots 21*a* in the retainer block slots 16*a*, to facilitate normal extension of the retainer block 16 into the middle plate profile slot 6*a* and the backing plate slot 16*b*, under spring tension. As further illustrated in FIG. 6 the retainer block 16 extends into the middle plate profile slot 6*a* and the rear plate slot 4*b* and is similarly biased by the retainer block springs 21. Moreover, a spring pin 17 extends forwardly from fixed attachment to the retainer block 16, through the spring pin access slot 14 in the front plate 10, and is designed to facilitate selective retraction of the retainer block 16 by finger or thumb pressure into the retainer block slot 16*a* against the tension in the retainer block springs 21, as hereinafter described.

Referring again to FIGS. 6 and 7, in a preferred embodiment the front plate 10 is glued to the middle plate 6, which closes the front of the lock housing 2 over the backing plate 6*b* (FIG. 6) and the front plate 10 is fitted with a front plate dead bolt slot 11 that corresponds to and registers with the middle plate profile slot 6*a* in the middle plate 6, as well as the backing plate slot 16*b* in the backing plate 6*b* and the rear plate slot 4*b* in the rear plate 4. The front plate 10 is further characterized by bolt access openings 13 for receiving corresponding bolts 8 that extend through the bolt access openings 13 and through corresponding middle plate bolt openings 8*b* in the middle plate 6, as well as through aligned backing plate bolt openings 8*d* in the backing plate 6*b* (FIG. 6). The bolts 8 seat in corresponding bolt retainers 8*c*, seated in the rear plate openings 8*a*, located in the rear plate 4. The bolts 8 thus removably and rotatably secure the front plate 10, the rear plate 4, the middle plate 6 and the backing plate 6*b* to each other on the lock housing 2, with the backing plate 6*b* recessed in the housing opening 3*a*, since both the front plate 10, the middle plate 6 (typically glued or otherwise fixed to the front plate 10) and the rear plate 4 are larger in diameter than the backing plate 6*b*, and rest against the front and rear surfaces, respectively, of the housing rim 3. This attachment facilitates adjustment of the tension in the bolts 8 and corresponding rotation of the front plate 10, middle plate 6 and backing plate 6*b* (FIG. 6), as well as the rear plate 4 in concert and in alignment with respect to the lock housing 2. The gripping leg access slot 12 in the front plate 10 accommodates the projecting gripping leg 24, which is attached or formed integrally on one end of the corresponding notch retainer 22, as illustrated in FIGS. 1–3 and 6. The keeper slot 25*a* is typically provided in the front plate 10 adjacent to the gripping leg access slot 12. Furthermore, the spring pin access slot 14 is located in the front plate 10 on the opposite side of the front plate dead bolt slot 11 from the gripping leg access slot 12, to receive the spring pin 17, attached to the retainer block 16, for manipulating the retainer block 16 into recessed configuration in the retainer block slot 16*a* in the middle plate profile slot 6*a*, against the bias of the retainer block springs 21, as hereinafter further described.

As further illustrated in FIGS. 4–6 of the drawings it will be appreciated that extension of the retainer block 16 from the retainer block slot 16*a* into the middle plate profile slot 6*a* and the backing plate slot 16*b* under the bias of the two retainer block springs 21, is limited by the provision of the pair of bolt legs 18*a*, projecting through the corresponding slotted plate slots 20 in the respective slotted plates 18 (FIGS. 4–6). The slotted plates 18 are therefore slidably seated for limited movement in the longer slotted plate openings 19, respectively. Accordingly, the retainer block 16 is normally maintained substantially in the position illustrated in FIG. 4, extended into the aligned front plate dead bolt slot 11, middle plate profile slot 6*a*, backing plate slot 16*b* (FIG. 6) and rear plate slot 4*b* when the adjustable dead bolt lock 1 is not in use, by the bias of the retainer block springs 21 and engagement of the extending distal ends of the slotted plate openings 19 in the slotted plates 18 with the corresponding bolt legs 18*a*, for purposes which will be hereinafter further described. Moreover, in a preferred embodiment of the invention a gripper strip 31 is glued or otherwise attached to the face of the retainer block 16 extending into the middle plate profile slot 6*a* (FIG. 6) and also into the backing plate slot 16*b* (FIG. 6) for enhanced frictional engagement with a deadbolt knob 30, as illustrated in FIG. 5. In another preferred embodiment a rear plate tab 4*a* (FIG. 2) is extended from the rear plate 4 into the middle plate profile slot 6*a* and backing plate slot 16*b* (FIG. 6) for engaging the opposite side of the dead bolt knob 30 in a tight frictional fit.

Figure 1:
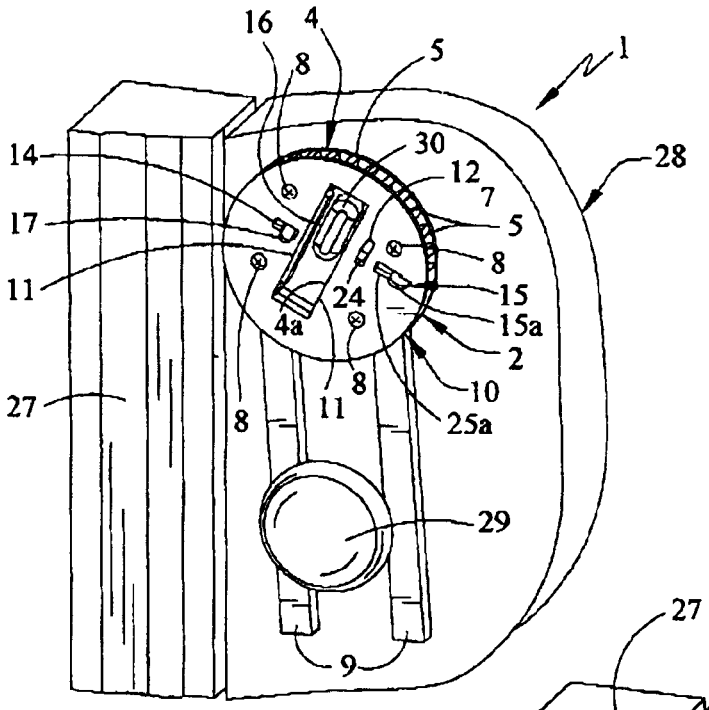
FIG. 1 is a perspective view of a preferred adjustable embodiment of the dead bolt lock of this invention in functional configuration on a dead bolt knob in locked configuration on a door, with the downwardly-extending, parallel legs positioned behind and on each side of the underlying door knob.
Figure 2:
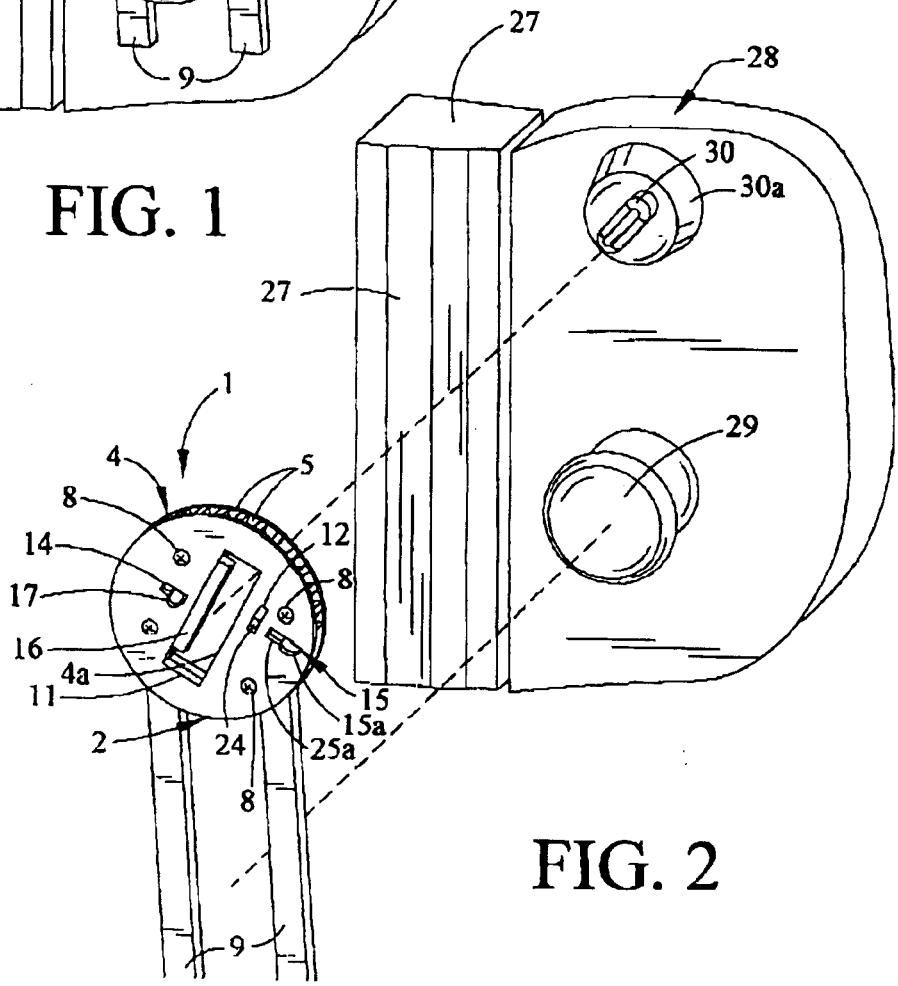
FIG. 2 is a perspective view of the adjustable dead bolt lock spaced from the dead bolt and door knob illustrated in FIG. 1, more particularly illustrating positioning of the adjustable dead bolt lock on the dead bolt knob and door knob.

Referring again to FIGS. 1 and 2 of the drawings the lock housing 2 of the adjustable dead bolt lock 1 is inserted on a dead bolt knob 30 mounted on the dead bolt housing 30*a* of a door 28 (FIG. 2) which lies adjacent to a door frame 27. When the adjustable dead bolt lock 1 is in functional configuration on the dead bolt knob 30 as illustrated in FIG. 1, the downwardly-extending housing legs 9 engage the inside surfaces of opposite sides of the connecting element of the door knob 29, located beneath the dead bolt knob 30 on the door 28, and stabilize the adjustable dead bolt lock 1 on the dead bolt knob 30. Additional security is provided by the spring-biased engagement of the gripper strip 31 on retainer block 16 and the dead bolt knob 30 and seating of the rear plate tab 4*a* against the opposite side of the dead bolt knob 30. Accordingly, when the adjustable dead bolt lock 1 is so installed on the dead bolt knob 30 and the door knob 29 as illustrated in FIG. 1, jarring, kicking or pushing the door 28 will not cause the adjustable dead bolt lock 1 to disengage the dead bolt knob 30 and the door knob 29, due to the spring-loaded retainer block 16 action and the close proximity of the downwardly-extending housing legs 9 and the inside surfaces of the door knob 29. Seating of the adjustable dead bolt lock 1 on the dead bolt knob 30 is quickly and easily effected as illustrated in FIGS. 2 and 6, by initially retracting the retainer block 16 from the front plate dead bolt slot 11 and the registering middle plate profile slot 6*a* by finger or thumb pressure applied to the spring pin 17, sliding the housing legs 9 behind and on each side of the projecting door knob 29 and then positioning the aligned front plate dead bolt slot 11, middle plate profile slot 6*a*, backing plate slot 16*b* and rear plate slot 4*b* on the dead bolt 30, to the position illustrated in FIG. 1.

Referring again to FIGS. 3–6 of the drawings, under circumstances where the dead bolt knob 30 is positioned at an angle with respect to the perpendicular as indicated, the front plate 10, middle plate 6, backing plate 6*b* and the rear plate 4 (FIG. 6) of the adjustable dead bolt lock 1 can be rotatably adjusted in concert on the lock housing 2 to orient the matching front plate dead bolt slot 11, middle plate profile slot 6*a*, backing plate slot 16*b* and the rear plate slot 4*b* into the same angular orientation as the dead bolt knob 30. This adjustment is facilitated by first moving the gripping leg 24 of the notch retainer 22 upwardly by finger pressure in the gripping leg access slot 12, against the bias in the retainer spring 26. This action slides the notch retainer 22 in the notch leg articulation slot 7 (FIG. 4) and displaces the rearwardly-extending notch leg 23 from the rim notch 5 in which it was seated by spring tension, to the position illustrated in FIG. 4. Extension of the notch leg 23 from the rim notch 5 against the bias of the retainer spring 26 is maintained by corresponding projection of the leg notch 15*c* of the keeper 15 into the notch 7 and into contact with the gripping leg 24 of the notch retainer 22, by action of the bias in the keeper spring 15*d* (FIG. 4). This action also allows free rotation of the front plate 10 and the middle plate 6 as a composite illustrated in FIG. 6, with the backing plate 6*b* illustrated in FIG. 6 and with the rear plate 4 (including the keeper 15 and the notch retainer 22) in concert with respect to the rim teeth 4 and the rim notches 5 of the fixed lock housing 2. This rotation is effective to match the angular orientation of the registering front plate dead bolt slot 11, middle plate profile slot 6*a*, backing plate slot 16*b* (FIG. 6) and rear plate slot 4*b*, with the dead bolt knob 30. When this accommodation position is reached by rotation of the front plate 10, the middle plate 6, the backing plate 6*b* and the rear plate 4 together, the keeper finger 15*a* of the keeper 15 is forced away from the gripping leg 24 against the bias of the keeper spring 15*d* by finger or thumb pressure to disengage the keeper leg 15*b* from the gripping leg 24 of the notch retainer 22. Accordingly, this pressure released from the gripping leg 24 facilitates return of the notch leg 23 into a corresponding underlying and matching rim notch 5 in the housing rim 3 by operation of the retainer spring 26, as illustrated in FIG. 5. The adjustable dead bolt lock 1 can then be easily inserted on the dead bolt knob 30 by initially slipping the housing legs 9 against the opposite inside surfaces of the door knob 29, applying finger or thumb pressure to the spring pin 17 extending from the spring pin access slot 14 in the front plate 10 to retract the retainer block 16 into the corresponding retainer block slot 16*a* against the tension of the retainer block springs 21, slipping the matching front plate dead bolt slot 11, middle plate profile slot 6*a*, backing plate slot 16*b* and rear plate slot 4*b* over the dead bolt knob 30 and releasing finger or thumb pressure from the spring pin 17, to facilitate pressure applied by the retainer block 16 against the dead bolt knob 30 by operation of the retainer block springs 21. In this manner, a dead bolt knob 30 of substantially any width not greater than the composite width of the front plate dead bolt slot 11, the registering middle plate profile slot 6*a* and backing plate slot 16*b*, as well as the rear plate slot 4*b*, can be stabilized by the adjustable dead bolt lock 1 of this invention.

Referring now to FIG. 8 of the drawings in another preferred embodiment of the invention a non-adjustable X-slot dead bolt lock 32 is illustrated, with no adjustment features in the X-slot housing 33. An X-slot 34, shaped by X-slot openings 35, is provided in the X-slot housing 33 to accommodate the dead bolt knob 30, illustrated in phantom. As in the case of the dead bolt lock 1 illustrated in FIGS. 1–7 of the drawings, a pair of housing legs 9 extend downwardly in parallel relationship with respect to each other from the X-slot housing 33 for seating on the inside surfaces of a door knob 29, also illustrated in phantom, when the X-slot dead bolt lock 32 is in the functional configuration illustrated in FIG. 8. It will be appreciated from a consideration of the X-slot dead bolt lock 32 that the X-slot 34 facilitates accommodation of dead bolt knob 30 in two angular configurations without the necessity of adjustment, as is the case in the embodiment illustrated in FIGS. 1–7 of the drawings.

Similarly, referring to FIG. 9 of the drawings a non-adjustable cross-slot dead bolt lock 37 is illustrated, having a cross-slot housing 38, fitted with a cross-slot 39 having cross-slot openings 40 that are vertically and horizontally-oriented, as indicated. A dead bolt knob 30, illustrated in phantom, is shown in vertical orientation, captured by the vertical ones of the cross-slot openings 40. The dead bolt knob 30 is prevented from rotating out of the locked configuration by the position of the cross-slot dead bolt lock 37, with the downwardly-extending legs 9 seated behind and on each side of the door knob 29, also illustrated in phantom.

FIGS. 10–12 illustrate an alternative embodiment of the cross-slot dead bolt lock 37 illustrated in FIG. 9, wherein a retainer plate 50, having a retainer plate body 51 and retainer plate legs 53 is slidably mounted on the rear surface of the cross-slot housing 38 by means of a pair of retainer plate screws 54. A retainer plate flange 52 typically projects from the top of the retainer plate body 51 for gripping purposes. Accordingly, the retainer plate 50 is adjusted upwardly in the direction of the arrows on the cross-slot housing 38 as the cross-slot dead bolt lock 37 is positioned on the dead bolt knob 30 and door knob 29 (both illustrated in phantom) as shown in FIGS. 10 and 11, and is adjusted downwardly in the direction of the arrow to seat against the rear surface of the dead bolt knob 30 and further stabilize the cross-slot dead bolt lock 37 on the dead bolt knob 30, as illustrated in FIG. 12.

FIGS. 13 and 14 illustrate other non-adjustable, or fixed configurations of the dead bolt lock of this invention, with the vertical access dead bolt lock 42 illustrated in FIG. 13 having a vertical access housing 43, provided with a vertical access slot 44 for receiving a vertically-oriented, locked dead bolt knob 30 (illustrated in phantom). A retainer plate 50 may be installed on the vertical access dead bolt lock 42, in the manner illustrated in FIGS. 10–12 relative to the cross-slot dead bolt lock 37. As illustrated in FIG. 14 the horizontal access dead bolt lock 46 has a horizontal access housing 47, fitted with a horizontal access slot 48 for receiving a dead lock 30 (illustrated in phantom) in the horizontal locked configuration.

It will be appreciated from a consideration of the fixed X-slot dead bolt lock 32, cross-slot dead bolt lock 37 (in all of its variations), the vertical access dead bolt lock 42 and the horizontal access dead bolt lock 46 illustrated in FIGS. 8–14, that under circumstances where securing of a single dead bolt lock of known locked angular orientation is desired, such as in the home or when traveling to a place having dead bolt locks of such known angular orientation, the fixed dead bolt locks described above can be used to accommodate and secure these dead bolts. Furthermore, under circumstances where the various dead bolt locks are to be supplied to a hotel, motel or condominium facility having multiple dead bolts designed with a common dead bolt locking configuration, a dead bolt lock having a single slot, either vertically-oriented or horizontally-oriented, or the X-slot or cross-slot configurations, can be utilized to effect the desired securing of the dead bolt, as further illustrated in FIGS. 8–14 of the drawings. Moreover, in the case of the cross-slot dead bolt lock 37 illustrated in FIGS. 10–12, the sliding retainer plate 50 serves to add security by engaging the rear surface of the dead bolt knob 30 when the dead bolt lock is in functional configuration on the dead bolt knob 30.

It will be further appreciated by those skilled in the art that the dead bolt lock of this invention, in all of the embodiments described above, is designed to accommodate substantially any dead bolt on substantially any door, including motel doors, hotel doors, homes, condominiums and the like, under circumstances where a door knob is located beneath the dead bolt, as is the case in most conventional door installations. In the simplified, fixed or non-adjustable designs, the lock housing 2 can be solid, with a slot or slots provided at the existing lock angle of a dead bolt knob 30 (FIGS. 8, 9, 13 and 14) without the provision of a front plate 10, middle plate 6, backing plate 6*b* or rear plate 4 and corresponding internal locking components, including the retainer block 16. Accordingly, as described above, the fixed dead bolt locks of this invention can thus be customized for a single dead bolt knob 30 lock angle, or for multiple dead bolts 30, as in a motel, hotel, home, condominium or the like. Moreover, the sliding retainer plate 50 can be added to the vertical access dead bolt lock (FIG. 13), as illustrated with respect to the cross-slot dead bolt lock 38 illustrated in FIGS. 10–12, to provide added security.

In the embodiment of the adjustable dead bolt lock 1, referring again to the drawings, the front plate dead bolt slot 11 and corresponding middle plate profile slot 6*a* and backing plate slot 16*b*, where applicable, as well as the rear plate slot 4*b*, can be of sufficient size to accommodate a dead bolt knob 30 of substantially any width and length, since the retainer block 16 is designed to extend into the aligned front plate dead bolt slot 11, middle plate profile slot 6*a* and aligned backing plate slot 16*b*, as well as the rear plate slot 4*b*, to compensate for dead bolts that are small and/or relatively narrow, such as the dead bolt knob 30 illustrated in the drawings. Furthermore, the position of the downwardly-extending housing legs 9 inside and on each side of the door knob 29 in all of the embodiments, insures that shaking or kicking of the door 28 from the outside will not dislodge the adjustable dead bolt lock 1 (or the fixed dead bolt locks described above) from the protective position on the dead bolt knob 30. Yet, the dead bolt locks of this invention, in all of the above described embodiments, are quickly, easily and efficiently removed from the door knob 29 and the dead bolt knob 30, should such removal be required in case of fire or other emergency, by simply pulling the lock housing outwardly (after first sliding the retainer plate 50 upwardly, if the dead bolt lock is so equipped) to clear the dead bolt knob 30 from the aligned slots and then lifting the dead bolt lock upwardly to remove the housing legs 9 from the door knob 29, and quickly and easily access both the door knob 29 and the dead bolt knob 30, as necessary.

It will be further appreciated that as heretofore described, in the embodiment illustrated in FIG. 6, the front plate 10 and middle plate 6 are glued or otherwise fixed together to facilitate precise alignment of the front plate dead bolt slot 11 and the middle plate profile slot 6*a* together, with the backing plate slot 16*b* and the rear plate slot 4*b*. The plates are preferably assembled in this manner to facilitate insertion of the respective retainer block 16, retainer block springs 21, notch retainer 22, retainer spring 26, keeper 15 and keeper spring 15*d* in the corresponding slots and notches provided in the front plate 10, middle plate 6 and backing plate 6*b*, as described above and as illustrated in FIG. 6. Alternatively, the front plate 10 and middle plate 6 can be molded or shaped together as a composite, with a plug or alternative access element (not illustrated) removed and reinserted for the same purpose, or by other techniques known by those skilled in the art. Furthermore, the various components of the respective dead bolt locks of this invention can be fabricated from a variety of materials, including metal, plastic, fiberglass and the like, in non-exclusive particular. For example, referring again to the drawings, the lock housing 2, X-slot housing 33, cross-slot housing 38, vertical access housing 43 and horizontal access housing 47 illustrated in the drawings can be injection-molded from suitable plastic materials, along with other elements of the devices, according to the knowledge of those skilled in the art. Moreover, although the lock housings in the embodiments illustrated in FIGS. 1–14 of the drawings are round, it will be appreciated that the lock housings can be otherwise shaped, typically in the configuration of an octagon or other polygon, as desired.

While the preferred embodiments of the invention have been described above, it will be recognized and understood that various modifications may be made in the invention and the appended claims are intended to cover all such modifications which may fall within the spirit and scope of the invention.

Having described the invention with the particularity set forth above, what is claimed is:

1. A dead bolt lock for removably engaging and securing a dead bolt knob on a door having a door knob, comprising: a housing; a pair of legs extending from said housing for engaging the door knob; and an opening provided in said housing for receiving the dead bolt knob and preventing the dead bolt knob from turning and unlocking the door, wherein said opening in said housing is round and comprising at least two notches provided in said housing; a front plate rotatably closing one side of said housing, and a front plate slot provided in said front plate; a rear plate rotatably closing the opposite side of said housing from said one side and a rear plate slot provided in said rear plate, said rear plate slot registering with said front plate slot in said front plate; a middle plate rotatably disposed in said opening in said housing, said middle plate connected to said front plate and said rear plate and a middle plate slot provided in said middle plate, said middle plate slot registering with said front plate slot and said rear plate slot for removably receiving the dead bolt; and a notch retainer slidably disposed in said middle plate for releasably engaging a selected one of said notches in said housing and substantially aligning said front plate slot, said middle plate slot and said rear plate slot with the dead bolt knob when said front plate, said middle plate and said rear plate are rotated and locked in concert with respect to said housing by operation of said notch retainer.

2. The dead bolt lock of claim 1 comprising an engaging member slidably mounted in said housing for extending into said opening in said housing and engaging the dead bolt and stabilizing said housing on the dead bolt.

3. The dead bolt lock of claim 1 wherein said opening in said housing is round and comprising a plurality of notches provided in said housing; a front plate rotatably closing one side of said housing and a front plate slot provided in said front plate; a rear plate rotatably closing the opposite side of said housing from said one side and a rear plate slot provided in said rear plate, said rear plate slot registering with said front plate slot in said front plate; a middle plate rotatably disposed in said opening in said housing, said middle plate connected to said front plate and said rear plate and a middle plate slot provided in said middle plate, said middle plate slot registering with said front plate slot and said rear plate slot for removably receiving the dead bolt knob; and a notch retainer slidably disposed in said middle plate for selectively disengaging and engaging said notches in said housing and substantially aligning said front plate slot, said middle plate slot and said rear plate slot with the dead bolt knob when said front plate, said middle plate and said rear plate are rotated and locked in concert with respect to said housing by operation of said notch retainer; and further comprising a retainer block slidably provided in said middle plate for extending at least into said middle plate slot in said middle plate, said retainer block releasably engaging the dead bolt knob and stabilizing said housing on the dead bolt.

4. The dead bolt lock of claim 3 comprising at least one block spring provided in said middle plate, said block spring engaging said retainer block for normally biasing said retainer block into said middle plate slot in said middle plate.

5. The dead bolt lock of claim 4 comprising a pin extending from said retainer block through said front plate for retracting said retainer block from said opening in said housing against the tension in said block spring responsive to pressure manually exerted against said pin.

6. The dead bolt lock of claim 3 comprising:

(a) at least one block spring provided in said middle plate, said block spring engaging said retainer block for normally biasing said retainer block into said middle plate slot in said middle plate; and (b) a pin extending from said retainer block through said front plate for retracting said retainer block from said opening in said housing against the tension in said block spring responsive to pressure manually exerted against said pin.

7. The dead bolt lock of claim 3 comprising a retainer spring fixed to said middle plate and said notch retainer for normally biasing said notch retainer in said one of said notches and a keeper slidably disposed in said middle plate adjacent to said notch retainer for selectively biasing said notch retainer from said notches.

8. The dead bolt lock of claim 7 comprising:

(a) at least one block spring provided in said middle plate, said block spring engaging said retainer block for normally biasing said retainer block into said middle plate slot in said middle plate; and (b) a pin extending from said retainer block through said front plate for retracting said retainer block from said opening in said housing against the tension in said block spring responsive to pressure manually exerted against said pin.

9. The dead bolt lock of claim 8 comprising a retainer access slot provided in said front plate for receiving one end of said retainer, a keeper slot provided in said front plate for receiving one end of said keeper and a pin access slot provided in said front plate for receiving said pin.

10. The dead bolt lock of claim 1 wherein said opening in said housing comprises a vertical slot for receiving the dead bolt knob.

11. The dead bolt lock of claim 1 wherein said opening in said housing comprises a horizontal slot for receiving the dead bolt knob.

12. The dead bolt slot of claim 1 wherein said opening in said housing comprises a cross-shaped slot for receiving the dead bolt knob.

13. The dead bolt lock of claim 1 wherein said opening in said housing comprises a X-shaped slot for receiving the dead bolt knob.

14. The dead bolt lock of claim 1 comprising a retainer plate slidably mounted on said housing for selectively contacting the dead bolt knob and stabilizing said dead bolt lock on the dead bolt.

15. The dead bolt lock of claim 14 wherein said opening in said housing comprises a vertical slot for receiving the dead bolt knob.

16. The dead bolt lock of claim 14 wherein said opening in said housing comprises a cross-shaped slot for receiving the dead bolt knob.

17. A dead bolt lock for removably engaging and securing a dead bolt knob on a door having a door knob comprising:

(a) a housing;

(b) a round opening provided in said housing;

(c) a plurality of notches provided in the top of said housing; a front plate and a middle plate rotatably closing one side of said housing, a front plate slot provided in said front plate and a middle plate slot provided in said middle plate; a rear plate rotatably closing the opposite side of said housing from said one side and a rear plate slot provided in said rear plate, said rear plate slot registering with said front plate slot in said front plate and said middle plate slot in said middle plate; a backing plate rotatably disposed in said round opening in said housing, said backing plate connected to said front plate, said middle plate and said rear plate;

a backing plate slot provided in said backing plate, said backing plate slot registering with said middle plate slot, said front plate slot and said rear plate slot, for removably receiving the dead bolt knob; and a spring-biased notch retainer slidably disposed in said middle plate for selectively engaging one of said notches in said housing and substantially aligning said front plate slot, said middle plate slot, said backing plate slot and said rear plate slot with the dead bolt knob when said front plate, said middle plate, said backing plate and said rear plate are rotated in concert with respect to said housing and locked in place by said notch retainer; and (d) a pair of legs extending from said housing for engaging the door knob.

18. The dead bolt lock of claim 17 comprising a spring-biased retainer block slidably mounted in said middle plate for extending at least into said middle plate slot in said middle plate, said retainer block releasably engaging the dead bolt knob and stabilizing said housing on the dead bolt knob.

19. The dead bolt lock of claim 18 comprising a keeper slot provided in said backing plate and a keeper slidably disposed in said backing plate slot adjacent to said notch retainer for engaging said notch retainer and selectively biasing said notch retainer from said notches in said housing.

20. A dead bolt lock for removably engaging and securing a dead bolt knob on a door having a door knob comprising:

(a) a housing having a shaped top portion;

(b) a round opening provided in said housing;

(c) a plurality of notches provided in said shaped top portion of said housing; a front plate and a middle plate fixed to said front plate for rotatably closing one side of said housing; a front plate slot provided in said front plate and a middle plate slot provided in said middle plate; a rear plate rotatably closing the opposite side of said housing from said one side and a rear plate slot provided in said rear plate, said rear plate slot registering with said front plate slot in said front plate and said middle plate slot in said middle plate; a backing plate rotatably disposed in said round opening in said housing and a backing plate slot and a keeper slot provided in said backing plate, said backing plate slot registering with said middle plate slot, said front plate slot and said rear plate slot, for removably receiving the dead bolt knob; a spring-biased notch retainer slidably disposed in said middle plate for selectively engaging one of said notches in said housing and substantially aligning said front plate slot, said middle plate slot, said backing plate slot and said rear plate slot with the dead bolt knob when said front plate, said middle plate, said backing plate and said rear plate are rotated in concert with respect to said housing; and a spring-biased keeper slidably disposed in said backing plate slot adjacent to said notch retainer for engaging said notch retainer and biasing said notch retainer from said notches in said housing;

(d) a retainer block slidably mounted in said middle plate for extending into said middle plate slot, said backing plate slot and said rear plate slot, said retainer block releasably engaging the dead bolt knob and stabilizing said housing on the dead bolt;

(e) at least one block spring provided in said middle plate, said block spring engaging said retainer block for normally biasing said retainer block into said middle plate slot in said middle plate;

(f) a pin extending from said retainer block through said front plate for retracting said retainer block from said opening in said housing against the tension in said block spring responsive to manual pressure exerted against said pin; and (g) a pair of legs extending from said housing for engaging the door knob.

* * * * *